US011486181B2

(12) United States Patent
Held

(10) Patent No.: US 11,486,181 B2
(45) Date of Patent: Nov. 1, 2022

(54) DEVICE FOR OPENING AND CLOSING SUPPORTED COVERS

(71) Applicant: Wolfgang Held, Hard (AT)

(72) Inventor: Wolfgang Held, Hard (AT)

( * ) Notice: Subject to any disclaimer, the term of this patent is extended or adjusted under 35 U.S.C. 154(b) by 44 days.

(21) Appl. No.: 16/973,049

(22) PCT Filed: Jun. 7, 2019

(86) PCT No.: PCT/EP2019/064933
§ 371 (c)(1),
(2) Date: Dec. 8, 2020

(87) PCT Pub. No.: WO2019/238556
PCT Pub. Date: Dec. 19, 2019

(65) Prior Publication Data

US 2021/0270072 A1 Sep. 2, 2021

(30) Foreign Application Priority Data

Jun. 13, 2018 (EP) ..... 18177609

(51) Int. Cl.
*E05F 5/06* (2006.01)
*E05F 5/02* (2006.01)
*E05F 1/10* (2006.01)

(52) U.S. Cl.
CPC ..... *E05F 5/02* (2013.01); *E05F 1/105* (2013.01); *E05Y 2201/22* (2013.01); *E05Y 2201/232* (2013.01); *E05Y 2900/20* (2013.01)

(58) Field of Classification Search
CPC ..... Y10T 16/61; Y10T 16/625; Y10T 16/628; Y10T 16/6285; E05F 5/00; E05F 5/003;
(Continued)

(56) References Cited

U.S. PATENT DOCUMENTS 6,846,053 B2 * 1/2005 Salice ..... A47B 88/467 312/334.14
8,668,288 B2 * 3/2014 Salice ..... A47B 88/47 312/109

(Continued)

FOREIGN PATENT DOCUMENTS

DE 102007022269 A1 * 11/2008 ..... E05F 1/105
EP 2801688 A2 11/2014

(Continued)

*Primary Examiner* — Chuck Y Mah
(74) *Attorney, Agent, or Firm* — John Alumit

(57) ABSTRACT

The present invention relates to a device and a method for opening and closing supported covers, in which a first compressive force is exerted onto a working body having a longitudinal axis in a first axial direction so that the working body is released from a latch connection, the working body being displaced in a spring-mounted manner from the housing into a first working position against the first compressive force direction when the first compressive force is cancelled, wherein a cover operatively connected to the working body is opened, is returned partially into the housing into a second working position by a renewed compressive force in the same axial direction of the working body; the working body, when partially returned, latches with the latch connection, and, by way of a continued compressive force in the same axial direction, the working body is returned against a resistance of a damping element into a starting position in the housing, the cover being returnable into a closed position.

15 Claims, 4 Drawing Sheets

(58) Field of Classification Search
CPC ... E05F 5/006; E05F 5/02; E05F 5/022; E05F 5/06; E05F 1/105; F16F 1/44; F16F 1/445; F16F 1/3732; F16F 1/3735; B65G 69/001; B60G 2204/4502; E05Y 2201/22; E05Y 2201/232; E05Y 2900/20
See application file for complete search history.

(56) References Cited

U.S. PATENT DOCUMENTS

| | | | | |
|---|---|---|---|---|
| 9,516,948 | B2 * | 12/2016 | Migli | A47B 88/463 |
| 10,246,924 | B2 * | 4/2019 | Hopkins | E05F 5/02 |
| 10,676,976 | B2 * | 6/2020 | Dubach | E05F 1/16 |
| 2009/0119873 | A1 * | 5/2009 | Bassi | F16F 9/3242 16/84 |
| 2015/0376927 | A1 * | 12/2015 | Brunnmayr | E05F 1/16 16/49 |
| 2016/0186476 | A1 * | 6/2016 | Held | E05C 19/165 49/263 |
| 2016/0215551 | A1 * | 7/2016 | Hillgaertner | E05F 3/18 |
| 2020/0232266 | A1 * | 7/2020 | Qi | A47B 88/473 |

FOREIGN PATENT DOCUMENTS

| | | | | |
|---|---|---|---|---|
| WO | WO2005122832 | A1 | 12/2005 | |
| WO | WO2013134798 | A1 | 9/2013 | |
| WO | WO2014117188 | A1 | 8/2014 | |
| WO | WO-2016197164 | A1 * | 12/2016 | A47B 88/463 |
| WO | WO2017004639 | A1 | 1/2017 | |

* cited by examiner

DEVICE FOR OPENING AND CLOSING SUPPORTED COVERS

The present invention relates to a device for opening and for damping a closing motion of supported, in particular spring-supported, covers, preferably in accordance with claim 1, as well as a method for opening and for damped closing of supported, in particular spring-supported covers, preferably according to claim 12.

In cupboards and drawers, as well as in other organizational units having a door or some other kind of cover, there is a persistent need to furnish aids by means of which the cover can easily be shifted between an open and a closed position.

Mechanisms by means of which a cover can be moved out of a closed position are fundamentally known. In them, a pressure can be exerted on the cover, as a result of which a mechanism is actuated that moves the cover partly in an opening direction vis-à-vis the person doing the actuation. Particularly in the case of covers without a handle, this is a possibility of grasping the cover securely from above or from the side using one's hand and opening it all the way. If this kind of cover is to be closed again, then it has to be transferred all the way into a closed position by hand, in order to overcome the force of the mechanism by means of which the cover was at least partly opened. Alternatively, the cover could be shut with enough force, but this pushes the cover into its frame in the closed or covering position. That can lead to damage both to the cover of the mechanism and to the frame.

WO 2014/117188 A1 teaches a head, which is adjustable via a thread, of a device that cooperates with a door. The device can be a damper or an element for opening the door. A combination of the two is not taught by WO 2014/117188 A1. In particular, WO 2014/117188 A1 does not provide any suggestion of causing he two apparatuses to interact on with one another and provide them in a common housing. One skilled in the art would instead, taking WO 2014/117188 A1 as a starting point, furnish dampers and an expulsion device in the form of two separate apparatuses side by side, in order to utilize the advantages of both apparatuses.

WO 2013/134798 discloses an ejection element for a door, which door functions by way of a spring mechanism. To avoid a hard impact of the ejection body on the back of its retainer, a fixed damping body is provided, which is intended to damp an impact of the ejection body when a door is actuated with a strong swing. The damper is not in contact with the ejection body if the latter is in a moved-outward position. The damper of WO 2013/134798 can therefore not aid in providing a damped closure of a door. For that purpose, the damper of the door would have to slide along the closing path, as can be provided in accordance with the present invention. The damping element of WO 2013/134798 is arranged in such a way that it does not interact with the ejection body until that body is already in retracted outset position.

The object of the present invention is thus to furnish both a device and a method by means of which a cover can be at least partly opened and a closing motion of the cover can be at least partially controlled.

This object is attained according to the invention by a device as defined by claim 1 and a method as defined by claim 12.

Preferred embodiments are recited in the dependent claims.

The device of the invention is characterized in that a working body with a longitudinal axis is furnished, which is located in a housing, in order to assume three working positions coaxially to the longitudinal axis:

By means of a first compressive force on the working body in the axial direction, the working body can be released from a latch connection and spring-supported out of the housing into a first working position counter to the first compressive force direction, and by a new compressive force in the same axial direction, the working body can be returned into a second working position partway into the housing; the working body can be latched to the latch connection and, by longer-lasting compressive force in the same direction, the working body can be returned, counter to a resistance of a damping element, into an outset position into the housing.

In this process, the working body and damper can be provided in a common housing.

As a result, the capability of easy replacement of the device, for instance upon integration into a wall of a piece of furniture, can be ensured. In particular, by this means it is possible to dispense with special fixations of the device of the invention in order to providing them in fixed fashion, for instance in a recess of a wall. The housing continues to be located in a displacement-free manner in the recess that preferably fits precisely, since no forces which could drive the housing out of the recess in act on the housing of the device.

The housing can be cylindrical or boxlike or some other shape; one side of the housing can be opened to allow the working body to move out. In particular, the housing can take the form of a small tube, in which the apparatuses of the invention can be located in a compact manner.

Thus the device can be located in even the smallest indentations or bores in side walls, or in regions of doors or drawers that are hard to gain access to. A further advantage is the ease of replacement, since the device of the invention, without further constructive provisions, can be located in the aforementioned indentations, bores, or the like and therefore can be equally simply pulled out and replaced with a replacement part without requiring tools. The housing does not necessarily have to have closed outer surfaces, as long as the apparatuses, in particular the damping unit and the expulsion apparatus, are supported and guided securely in their position and motion relative to the housing.

A connection clamp between and/or around the apparatuses, which ensures sufficient positional stability of the device, particularly in the recess, can also, in accordance with the invention, be a housing.

Preferably, the damper and expulsion apparatus contact one another at least in the outset position and in an outward-extended position of the working body. Especially preferably, the dampers and the expulsion device, which can have the working bodies, are in contact with one another and/or are operatively connected to one another when there is any movement, and in any position, of the working body, particularly relative to the housing. The dampers and the expulsion device can preferably be operatively connected with one another. In particular, the damper in an outward-extended position of the working body can contact the expulsion device. The expulsion device can at least have the working body but can also be embodied with a connecting member, hooks and/or at least one of each of the elements described below, which cooperate with the working body.

According to the invention, the device has at least one apparatus by means of which the cover can be opened, or in other words can be moved outward from an outset position, and a second apparatus by means of which a closing motion of the cover can be accomplished in damped fashion. At least one working plane can be provided here, which is operatively connected to the apparatuses and to the cover that is to be opened. The first and second apparatuses can be provided in a common housing. Preferably, the apparatuses are located one after the other or coaxially to one another, and at least partially (radially) one inside the other. At least one of the two apparatuses can be braced on a rear end of the housing and preferably anchored to it. Preferably, the two apparatuses are connected (fixedly) to one another. Preferably, the apparatus is also suitable for closing the cover in a damped fashion.

Supported covers according to the invention are in particular covers of such a kind that by way of at least one hinge or a moving element, an opening under them is made available; the cover can be opened both parallel to an opening (for instance a drawer) and at an angle to the opening (such as a cabinet door).

For opening, the working body can be supported movably relative to a latch mechanism and stressed by spring means. By means of a compressive force counter to an opening direction of the cover, the latch mechanism, open the working body, as a result of which the spring can relax, and the working body can be moved with spring support out of the housing. Since the working body of the cover is adjustable, or can be operatively connected to it, it can move the cover out of a closed position, as a result of which the cover can be grasped by a user, and thus an opening shift in position, in particular by hand, is prepared for.

For closing, the cover can be spring-supported or can have means which fundamentally enable a restoration of the cover to a closed position. In this respect, however, the return force of the spring or other means for the restoration should be less than the return force of the spring or energy storage means by means of which the working body moves the door out of a closed position, in order to enable any opening of the cover, however slight, by means of the working body.

Typically, the means for resetting the cover to a closed position can be activatable as soon as a specific, predefined opening angle of the cover relative to its frame, or to a closed position, fails to be attained. Instead of an opening angle, this can also involve an opening spacing of the cover from the opening, in particular in the case of drawers, that fails to be attained.

As a result it can be prevented that the cover, in a broad opening position, performs an unwanted restoration to the closed position. It can therefore also be necessary first to put the cover in a position in which the means for resetting the cover exerts a return force of the cover in the direction of the closed position, so that a functional cooperation of the cover with the device of the invention is made possible.

Fundamentally, the means for resetting the cover to a closed position can be dispensed with, since if the cover has been moved forcefully in the direction of the closed position, the device of the invention prevents the cover from undesirably striking its own frame in the closed position. However, the means for resetting the cover are advantageous, in order to move the cover into a closed position after the spring force of the spring of the working body has been overcome.

It can therefore be necessary to furnish the cover, upon closure, with not only the furnished return force at the cover by a slight contact with a small quantity of additional energy of motion, in order to overcome the force of the spring at the working body and to make it possible to grasp the working body at the latch mechanism, which can keep the working body in a retracted position.

The (spring) force (return force) that is present at the cover because of the means can be sufficient to overcome the resistance of the damping element, in particular a second spring, which charges the damping element, and as a result the cover can be shifted into a closed or outset position.

Fundamentally, the device of the invention can be furnished with at least one of the following features:

- a housing, which can have at least one opening;
- a working body as a contact element with the cover, which working body can be shiftable out of the opening between an outset position in the vicinity of the opening and a first working position, and the working body in the first working position can be shifted out of the housing relative to the outset position;
- a mechanism for opening the cover, in particular having a spring and detent element, and the spring can be fixable in a tensed state, the working body can be releasable from the detent element by means of a frontal exertion of force on that working body;
- and the working body can be movable out of the opening in spring-loaded fashion; and
- the working body, when force is exerted again frontally on the working body, can be returned back in the direction of the housing in spring-loaded fashion into a second working position, and the detent element can be fixable;
- a damper, which can preferably have a spring element and/or a fluid chamber and/or a piston that can be shifted in the fluid chamber, and a portion of an exertion of force by a cover onto the working body in its first working position can be compensated for by means of the spring element; and
- the damper can be embodied for returning the working body, when there is persistent exertion of force, out of the second working position into its first position by shifting of the piston in the fluid chamber;
- the damper and the mechanism for opening the cover can be located coaxially or parallel to one another in a direction of motion of the working body;
- the spring of the mechanism for opening the cover can be braced against an outer side of the fluid chamber;
- the spring of the mechanism for opening the cover can be braced against the working body and/or the working body can be shiftable by means of the spring;
- the working body can have a carrier, in particular a locking clamp, which can be latchable with the latch connection, in order to restrain the working body in the vicinity of the opening;
- the piston can be fixed relative to the housing;
- the fluid chamber can be movable relative to the housing coaxially to the working body by means of the spring element;
- that the fluid chamber can be located in fixed fashion and the piston can be located in shiftable fashion in the housing and the fluid chamber;
- and the spring of the mechanism for opening the cover can be preferably braced against an outer side of the piston and/or can be located shiftably thereon;
- that the latch connection is embodied as a connecting member, which the carrier can engage in locking fashion.

It can expediently be provided that a locking clamp on the working body can engage the latch connection and restrains the working body upon engagement with the latch connection. Fundamentally, the working body can be supported displaceably relative to the latch means, and the latch means can be provided for fixation, particularly on the latch means, by means of latching the working body with its locking clamp. Preferably, the connection between the latch means and the locking clamp can be released from the latch means by a pressure counter to a spring-tensing direction of motion of the working body onto the locking clamp, or onto the working body. This can be embodied in a similar way to an actuating element of a ball-point pen for inserting and removing the pen refill.

In a preferred further embodiment of the present invention, it is provided that the latch connection is displaceably supported relative to the housing. Fundamentally, the latch connection can be fixed on the damping element. At least a portion of the damping element can in turn be supported displaceably relative to the housing, and therefore although a fixation of the latch connection is made possible, the latch connection can nevertheless be located operably relative to the housing.

In a further embodiment of the invention, it is especially preferred that the latch connection is located on the damping element, or at least is operatively connected or anchored to the damping element. The latch connection can be (spring-) supported preferably in damped fashion relative to the housing. Fundamentally, the damping element of the invention can be embodied for proportionally creating a counterforce to a force acting on the damping element. This means that if a damping element is actuated with even slight pressure, it yields, while when acted on suddenly, in particular with a strong compressive force, it produces an enhanced resistance to the compressive force being exerted. This can have such a major effect that if a damping element is actuated gently, it can be displaced with almost no resistance, yet when a compressive force is exerted suddenly, it resists and there is virtually no change in its position.

As a result, the damping element, upon latching between the latch connection and the carrier, in particular the locking clamp, is able to counteract the vibration of the (spring-supported) cover, and as a result a resistance is furnished that can enable the latching and at the same time can prevent the cover from striking its closed position, since the cover can be restrained beforehand by the damping element.

If the momentum of the cover is used up by latching work counter to the spring tension, the cover can still be in a spring-supported condition, or at least can be furnished with a return force in the direction of its closed position, as a result of which the damper, after latching, can be actuated, or returned to a rearward position inside the housing, preferably gently, by the return force. The working body can be returned into an outset position or a first position, and as a result the travel into a closed position can be enable for the cover. During the (entire) displacement process of the damper, the cover can contact the working body and furnish the necessary force to charge the damper counter to a return force of a damper spring or of some damper energy storing means embodied in some other way.

In a further embodiment of the invention, it is especially preferred that the damping element has a piston and a damping housing. The piston or the damping housing can be operatively connected to the latch connection, and in particular secured to it. The respective other element then is preferably connected to the housing of the device. The piston is supported movably in the damping housing, which can also be called a fluid, counter to a fluid resistance, or the piston is fixed and the damping housing is movable. In this situation the fluid resistance upon a relative motion of the housing and piston can exert a damping action on the movability/motion of the piston relative to the damping housing. The fluid furnished can, by means of a narrowed region, reach an opposed region of the piston. Since this region is smaller than a cross section of the piston, the result is a delay in shifting the piston, and the piston motion is advantageously coupled to the amount of fluid displaced from one side of the piston to the other side of the piston. The resistance of the damper can also depend on the ratio between the cross sections of the piston and the narrowed region.

Advantageously, both the mechanism for opening the cover and the damping element can be provided in the same housing. An arrangement in which the damper can be provided coaxially behind or also at least partially inside the mechanism for opening the cover is especially advantageous; the mechanism for opening the cover via the damping element is located on the housing, or can be changeably supported in its position. By varying the location of the movable part (piston or damping housing) of the damping element, the mechanism for opening the cover can be shiftable in the housing. Fundamentally, the damping element and the mechanism for opening the cover also be located parallel to one another; each part can have a working body, and the working bodies are located approximately parallel to one another. It is also possible for each part to have its own housing; then both the mechanism for opening the cover and the damping element can be secured on its respective housing. Especially in the case of a parallel arrangement of the two apparatuses of the device of the invention, it can be necessary to maintain a defined disposition of the individual apparatuses relative to one another. A relative orientation of the two apparatuses to one another in which a cover that is to be closed, upon interaction with the mechanism for opening the cover, can, after being latching with the latch connection, already contact the damping element, but does not press the damping element all the way inside.

In a further embodiment of the invention, it is especially expedient that the working body is embodied in multiple parts, and each part of the cover can be provided in the same or different housings.

In a further embodiment of the invention, it is especially advantageous that at least two parts of the multi-part working body are provided parallel to one another with their respective longitudinal axis.

It is especially expedient that one of the two parts of the working body can be coupled with the damping element and the other part of the working body can be coupled with the latch connection.

Expediently, it can be provided that the part of the working body having the damping element can be located before or behind the part of the working body having the latch connection.

In an especially preferred refinement of the present invention, it is provided that the cover is embodied with a return element, which when the cover is opened is furnished with a return force effecting a closed position of the cover, and in particular is spring-supported; upon opening of the cover, the spring can be tensed and can be relaxed once the opening is closed. Fundamentally, the proper function of the device of the invention is also ensured if the cover is closed by a suitable hand motion, in order to charge the mechanism for opening the cover in tensed fashion for another actuation spring. Then, however, the damping element might still be in a disengaged position, and therefore the working body might still be outside its initial position or closed position, in which it is retracted into the housing. Accordingly, a cover could position, and therefore the working body can still be located outside its initial position or its closed position, in which it is retracted into the housing. Here, a cover could also have a slight spacing relative to its closed position. In particular for shifting the damper in the device of the invention to a stressed position, in which the working body is in an outset position or initial position, it can be advantageous to furnish the cover with at least one element which shifts the cover into its closed position with a return force. Here, possible return elements can be embodied such that upon a full opening of the cover, they exert no force on the cover that forces the cover back into a closed position. As soon as a defined angle between the cover and the opening to be closed, or the frame of the cover, is undershot, the return element can be activated, and as a result a return force is exerted on the working body and forces the working body back into a closed position. As a result, the closing process can be reinforced by the return element; in particular, the damping element can be pushed back into an outset position yet nevertheless the cover can be kept in a fully opening position without the exertion of force. Instead of an opening angle, an opening spacing, which is undershot, can actuate a means that exerts a return force on the cover. This can be especially useful for drawers.

In a method of the invention for opening and for damping a closing motion of supported covers by means of a device of one of claims 1 through 11, a first compressive force is exerted in a first axial direction upon a working body having a longitudinal axis, and as a result the working body is released from a latch connection; the working body, after the first compressive force is undone, is shifted with spring support out of the housing into a first working position counter to the first compressive force direction; a cover that is interacting with the working body is opened, and by a renewed compressive force in the first axial direction of the working body, the working body is returned partway into the housing in to a second working position; the working body upon being partially returned is latched with the latch connection, and by compressive force that continues to be exerted in the same axial direction, the working body is returned counter to a resistance of a damping element, to an outset position in the housing, and the cover can be returned back into a closed position.

Fundamentally, the present invention can relate to a covering system with a cover of either the flap type or slidable type as well as to a device of the invention, in particular in accordance with claims 1 through 10; the cover can be embodied with means that are able to furnish a return force into a closed position of the cover.

In the present invention, a piece of furniture is also claimed which has the device of the invention for opening covers and damping a closing motion upon closure of the cover. The device can be provided in a wall, in particular a side wall, a floor, or a ceiling of the piece of furniture. Especially preferably, the device of the invention is provided in a bore in the wall, in particular being recessed therein. As a result, an especially space-saving accommodation of the device is provided.

The device of the invention can also be provided as part of a guide, for instance for a drawer, and in particular can be integrated with the drawer.

Also according to the present invention, a system for opening and closing a flap-type or slidable cover of pieces of furniture having a device according to the invention for opening and damping a closing motion of the cover, in particular in accordance with claims 1 through 11, is claimed; the cover is embodied with means which furnish a force for returning to a closed position of the cover.

An advantageous embodiment will be described in further detail below with reference to the appended drawings. In the drawings.

Figure 1:
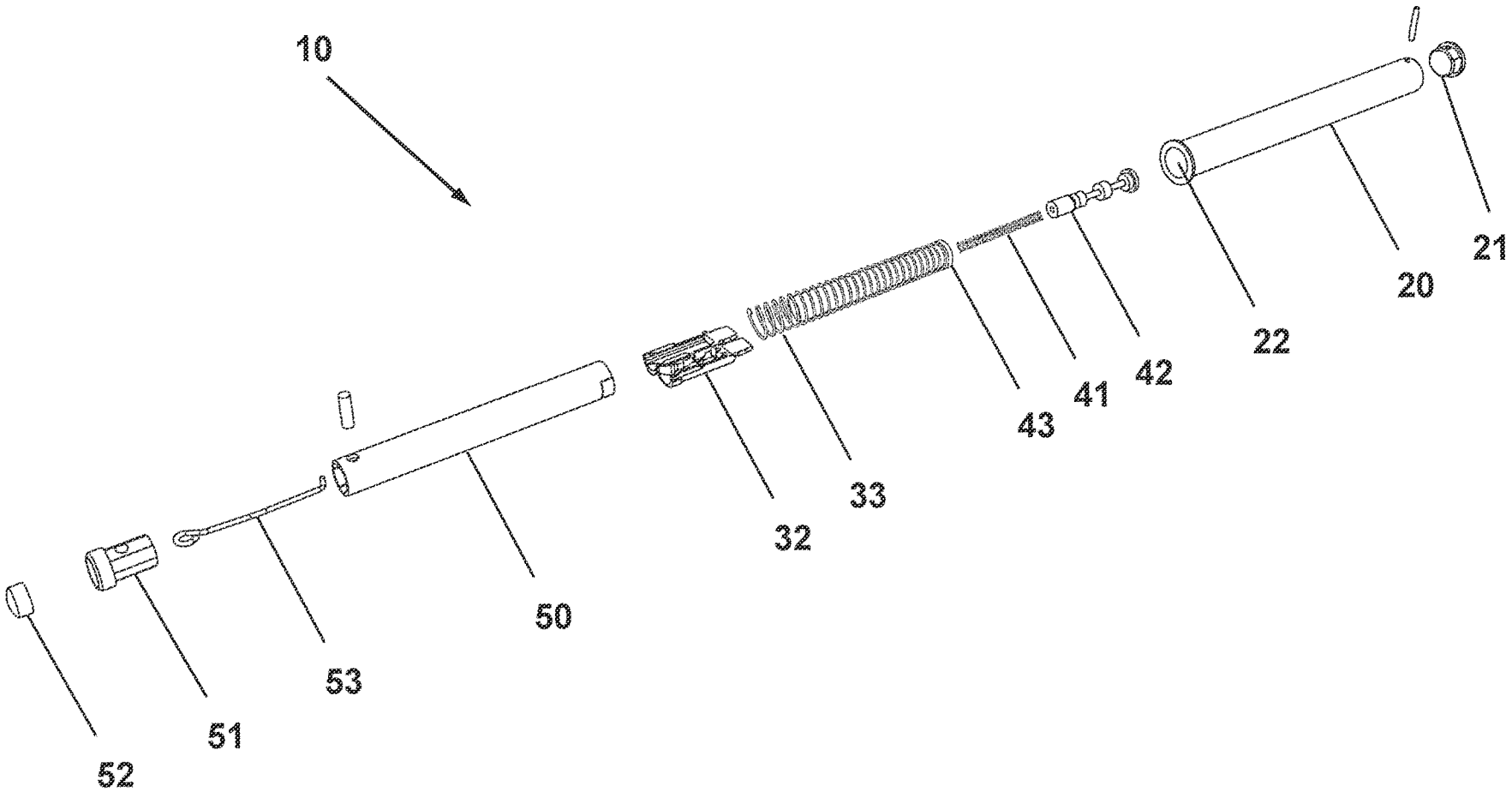
FIG. 1 shows an exploded view of a device of the invention for opening and closing covers.

FIG. 1 shows an exploded view of the possible components of a preferred embodiment of the device 10 of the invention for opening and closing covers. Fundamentally, all the components of the device 10 of the invention are located as here in (common) housing 20, in particular a retracted position, which can be called the outset position. The housing 20 can have a cap 21 in a rear region, by way of which cap, a fluid chamber can for instance be filled with fluid. In a rear region of the housing 20, that is, a region facing away from the opening 22, a damping element can be provided, which can for instance have a spring 41 and damping components, which in particular include a piston 42, which can be braced inside the housing against the rear region, which may have the cap 21.

The damping element can have the damper housing 43, which in its interior can have a stop against which the spring 41 can be braced. Counter to the spring pressure of the spring 41, the damper housing 43 can be supported variably in its position inside the housing 20. The damper housing 43 can in particular have a fluidic barrier in its interior, by way of which barrier fluid from the damper can be kept back, to prevent leakage.

Coaxially to the damper, preferably on an outer circumference of the damper housing 43, a spring 33 can be located, which interacts with a working body and can have the following components: a base body 50 with a front region 51/52, which can be connected detachably to the base body 50, and a carrier 53, which can be latched releasably to a connecting member 32. The connecting member 32 can be located on the damper housing 43, on a side facing toward the working body. Upon latching of the carrier 53 with the connecting member 32, the working body can be fixed relative to the connecting member 32 and also fixed relative to the damper housing 43, as can be seen particularly from FIG. 2.

Optionally, a rubber buffer 52 can be located on a front end of the working body; this buffer provides protective contact with a cover that is to be opened or closed.

Figure 2:
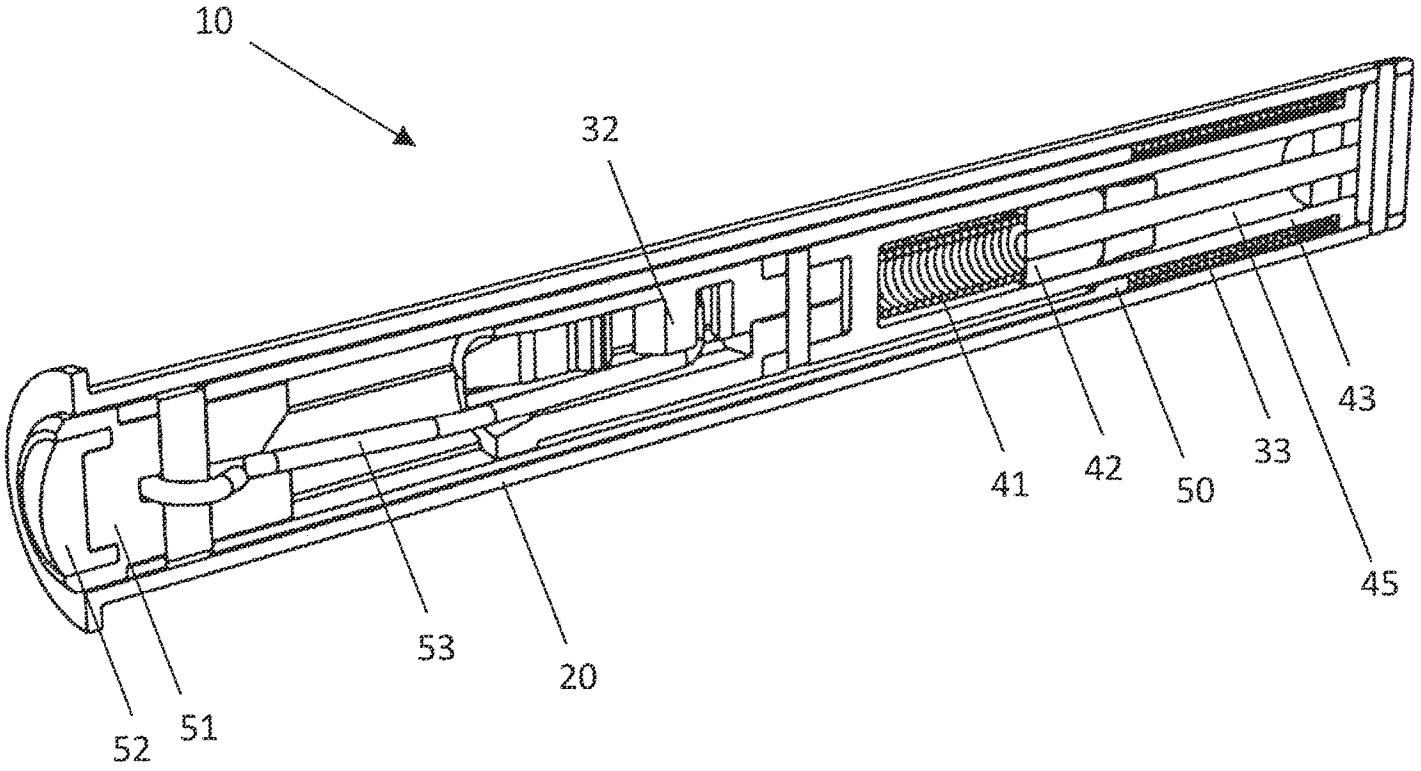
FIG. 2 is a cross-sectional view of a preferred embodiment of the device of the invention for opening and closing supported covers, in which device the working body is located in an outset position in the housing.

FIG. 2 represents the device of the invention in an outset or retracted position of the working body. In that position, the spring 41 of the damper and the spring 33, which rests on the base body 50 of the working body, can be in a tensed position. The damper spring 41, in this position, can be restrained, for instance by a cover resting on the front region 51/52 of the working body. As soon as the cover is removed by hand from the working body of the device 10 of the invention, the spring 41 can relax, and the damping element in the housing 20 can be moved in spring-loosening fashion (41). As a result, the working body can additionally move out of the housing 20 by the length of the stroke of the damping element.

The spring 33, which can cooperate with the base body 50 of the working body and, together with the connecting member 32, can furnish a mechanism for opening a cover resting on the working body, and in particular on the contact region 51, 52, can, by latching of the carrier 53, be retained in the connecting member 32 and fixed on the housing 43 of the damper. For that purpose, the connecting member 32 can be fixed on the end of the housing of the damper 43 or alternatively on the piston 42. For fixation on the piston 42, the housing 43 and piston can be reversed in their positions, whereupon the damper housing 43 can be fixed on the housing 20. Fundamentally, the damper can also be provided ahead of the element for expelling the working body, or can form the tip of the working body.

The working body, connecting member 32 and damper housing 43 (or piston 42, depending on the arrangement) can therefore, in the latched state of the carrier 53 with the connecting member 32, form a unit which in particular by means of the damper spring 41, be supported movably coaxially to the housing 20. The connecting member can then accordingly be supported movably in the housing and/or connected to the damper.

By means of a compressive force on the front region 51/52 of the working body, the carrier 53 is released/unlatched out of the connecting member 32. If the compressive force of the front region 51/52 of the working body is then withdrawn, the spring 33 can relax (FIG. 4 III) by means of a relative motion of the base body 50 of the working body relative to the damper housing 43. If a cover which had been lying on the working body is removed from the working body, the damper spring 41 can also relax, as a result of which the working body can be shifted out of the outset position into a first working position (FIG. 3).

Figure 3:
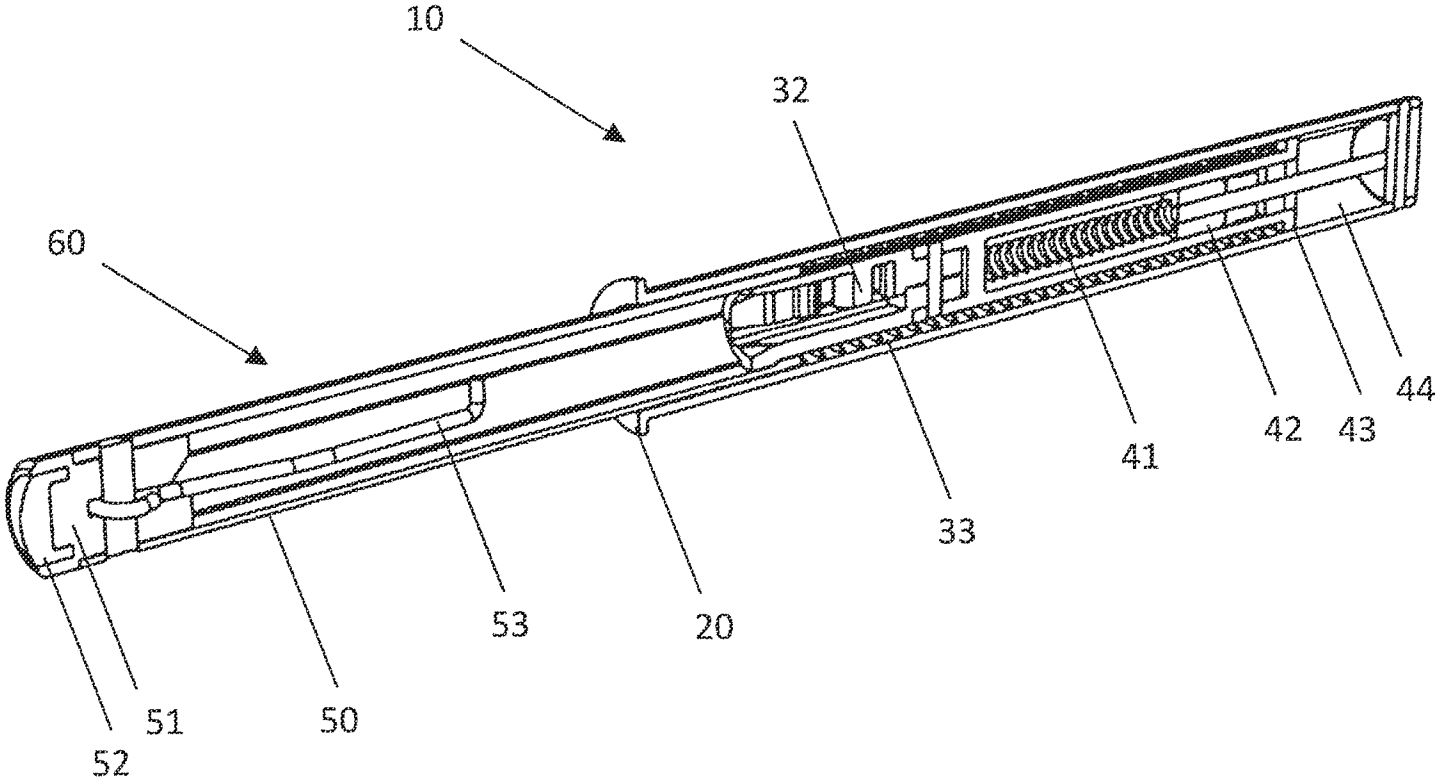
FIG. 3 is a cross-sectional view of a preferred embodiment of the device of the invention for opening and closing supported covers, in which device the working body is located in a first working position outside the housing.

FIG. 3 shows a preferred embodiment of the device 10 of the invention in a first working position, in which the working body 60, with its base body 50, is moved out of the housing 20 into a first working position. The device 10 can in particular assume this position whenever the connection between the connecting member 32 and the carrier 53 is undone, and a cover to be moved (opened) by means of the device 10 has been removed from it. Fundamentally, the device is suited for creating a certain distance between the cover that is to be opened and a frame, this distance being furnished in particular by the stroke of the working body out of the starting position into the first position.

By grasping the cover from behind and opening it further, the cover can be opened all the way, for instance at a 90° angle or more to the frame of a door, as a result of which the cover is removed from the working body of the device 10. In such a state, no external forces act on the device 10, and therefore both the spring 33 of the mechanism for opening the cover and the damper spring 41 can be in relaxed form relative to an outset position of the working body, or in other words can at least partially relax. With the relaxation of the damper spring 41, a relative motion between the piston 42 and the damper housing 43 is brought about, as a result of which a chamber 44 is formed, in which a fluid, for example a gas or a liquid and in particular a silicone substrate, can be provided. This fluid can be provided in an outset position of the working body as shown in FIG. 2, in a region which is marked by reference numeral 45. By means of the at least partial relief of the spring 41, the housing of the damper 43 is moved by a stroke inside the housing 20 which can be approximately equivalent to the coaxial length of the fluid chamber 44 in the housing 20. The damper housing and damper piston can also be located in reverse order in the housing, so that the piston can be provided such that it is shiftable variably in the housing. In such a case, the damper housing can be connected to the housing of the device, or it can be embodied as a part thereof.

The damping action of the damping apparatus can in particular be furnished in that when force is exerted on the working body and returns the working body into the housing 20, the fluid has to be forced out of the chamber 44 and returned to the region 45 shown in FIG. 2. The necessary work for forcing the fluid back into the region 45 is counteracted by a displacement of the working body back in an outset position in damping fashion.

By means of a displacement of the working body coaxially into the housing 20, the carrier 53 with the connecting member 32 can be brought back into a state of latch connection, and the spring 33 is tensed. An accurate course of opening and closing in a preferred embodiment can be found in FIG. 4.

As seen for instance in FIG. 3, the damper and the expulsion device can be located at least partially one inside the other in the coaxial direction. The expulsion device can be formed by the mechanism for opening the working body and/or can be realized at least partly by one of the following components: working body and/or spring 33 and/or connecting member 32 and/or base body 50.

Thus the working body and/or spring 33 and/or connecting member 32 and/or base body 50 of the expulsion device/mechanism for opening the cover can be supported radially outside, that is, above the damper, in particular radially outside a region of the damper, and especially preferably radially outside the damper housing. The damper can thus be surrounded (radially) and/or (radially) enclosed by the aforementioned elements.

Figure 4:
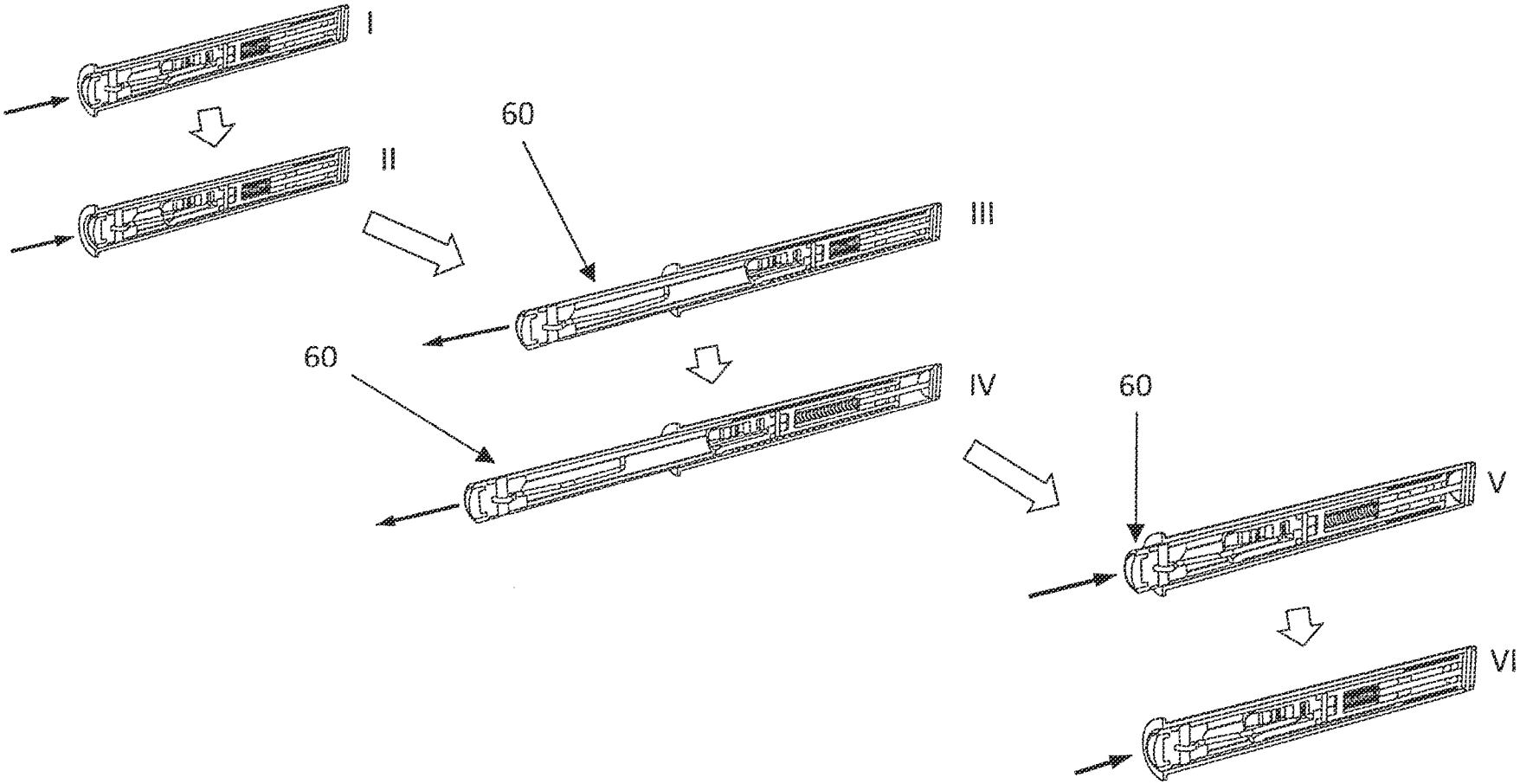
FIG. 4 is a series of illustrations that shows the course upon actuation of the device of the invention in a preferred embodiment, with the working body in its outset position, its first working position, and its second working position.

FIG. 4 shows in detailed fashion the procedure of moving the working body into and out of the housing 20 in six steps I through VI.

I in FIG. 4 shows the working body 60 in an outset position inside the housing 20.

By means of a first pressure coaxially to the alignment of the working body 60 or in other words to the direction of motion of the working body in the housing 20, the working body is easily thrust into the housing 20, as a result of which the carrier 53 is released (II) from the connecting member 32.

As soon as the carrier 53 is released, the spring 33 can relax (III), which previously had been spring-loaded and fixed (II) between the damper housing 43 and the working body. The situation shown at III of the device 10 of the invention is equivalent to a snapshot, in which a cover that is to be opened can still lie in a front region of the working body, and therefore the damper spring 41 is still restrained in a tensed position.

Fundamentally, it can be advantageous that, as the spring for the mechanism for opening covers, a spring 33 with a higher spring constant than the damper spring is used. The spring 33 should be capable of exerting enough force to move the cover out of a closed position. In this situation, it may be necessary to overcome a return force of the cover that is intended to keep it in a closed position. It can therefore likewise be necessary that the spring 33 have a higher spring force than the force with which the cover rests on the device of the invention.

The spring 41, contrarily, serves to charge the damper and can therefore be embodied with markedly less spring force. The spring force of the damper can in particular be weaker than the return force with which a cover is to be restrained in a closed position. Since the force of the cover on the device 10 of the invention is greater than the spring force of the spring 41, the spring in step III] remains in a tensed state until such time as the cover rests on the working body 60.

IV shows the device of the invention in a first working position, in which the cover to be opened is at a distance from the device, or in other words no longer rests on the working body 60. In this position, relative to III, the damper spring 41 is now also at least partially relaxed, specifically by the length of the stroke of the piston 42.

Upon movement of the working body 60 into the housing 20, as shown at V, an operative connection between the carrier 53 and the connecting member 32 is reset, and the spring 33 is tensed. This represents the second working position of the working body 60.

In this procedure, the damper can already be moved at least partially relative to the housing 20, as a result of which the fluid chamber 44 already has a reduced volume, compared to a first working position, since the housing 43 of the damper has already been moved partway back into its outset position shown in I. V shows the device 10/working body 60 of the invention in a second working position, in which, now, because a furnished return force is exerted on the cover, the cover does rest on the working body, but is not yet fully in the closed position. By means of the return force of the cover, the working body 60 can now be returned in damped fashion to its outset position (IV), as a result of which the cover, supported on the device, can be returned gently into a closed position. The return force exerted in this process on the cover can in particular be furnished by means provided on the cover which for instance effect a spring-supported restoration of the cover into a closed position, as soon as the cover relative to a closed position or a frame, by means of the spring force, enables a return solely of the cover into the closed position.

The invention claimed is:

1. A device (10) for opening and damping a closing motion of supported covers, such as in cupboards and drawers and other organizational units, having a working body (60) with a longitudinal axis, which enclosed in a housing (20), for assuming three working positions coaxially to the longitudinal axis;

by means of a first compressive force on a front region of the working body (60) in the axial direction, a carrier (53) of the working body is released out of a connecting member (32) that is connected to the housing thereby displacing the working body out of the housing (20) to assume a first working position that is counter to the first compressive force direction;

by means of a renewed compressive force in the same axial direction, the working body (60) is returnable to a second working position at least partially inside the housing (20), and the carrier (53) of the working body (60) is latchable with the connecting member (32); and by longer-maintained compressive force in the same direction, the working body (60) counters resistance to a damping element that is disposed in a rear region of said housing, in order to return to an outset position in the housing (20).

2. The device of claim 1, characterized in that a locking clamp (53) on the working body (60) can be grasped by reaching into the connecting member (32) and restrains the working body (60) upon engagement with the connecting member (32).

3. The device of claim 1, characterized in that the connecting member (32) is displaceably supported relative to the housing (20).

4. The device of claim 1, characterized in that the connecting member (32) is located on the damping element, which is spring-supported (41) in damped fashion relative to the housing (20).

5. The device of claim 1, characterized in that the damping element has a piston (42) and a damping housing (43).

6. The device of claim 1, characterized in that a piston (42) or a damping housing (43) are fixedly placed on the housing (20); and that the respectively other part (42/43) is displaceable in damped form in the housing (20).

7. The device of claim 1, characterized in that portions of the working body (60) have individual housings (20).

8. The device of claim 7, characterized in that at least two parts of the multi-part working body (60) are provided with their respective longitudinal axes parallel to one another.

9. The device of claim 7, characterized in that one of the two parts of the working body (60) can be coupled with the damping element, and the other part of the working body (60) can be coupled with the connecting member (32).

10. The device of claim 9, characterized in that the part of the working body (60) having the damping element is located on either side of the part of the working body (60) having the connecting member (32).

11. The device of claim 1, characterized in that the cover is embodied with a return element, which upon opening of the cover is furnished with a return force acting into a closed position relative to the cover, and is spring-supported, and the spring can be tensed upon opening of the cover and can be relaxed upon closure of the opening.

12. A method for opening and closing supported covers by means of a device of claim 1, in which a first compressive force is exerted on a working body having a longitudinal axis in a first axial direction, as a result of which compressive force the working body (60) is released from a connecting member (32);

after the first compressive force is undone, the working body (60) is displaced in spring-supported fashion out of a housing (20) into a first working position counter to the first compressive force direction, and a cover that is operatively connected to the working body (60) is opened;

and by a renewed compressive force in the same axial direction of the working body (60) into a second working position is returned partway into the housing (20);

and the working body (60) upon partial return is latched with the connecting member (32); and by further persisting compressive force in the same axial direction, the working body (60) is returned into an outset position into the housing (20), counter to a resistance of a damping element, and the cover can be returned to a closed position.

13. A system for opening and closing a cover of furniture pieces, the cover being capable of being swung shut or displaced, having a device of the invention for opening and damping a closing motion of the cover of claim 1, wherein, for the cover, means are provided which furnish a return force into a closed position of the working body.

14. A piece of furniture having a device for opening and damping the closing motion of a working body of the piece of furniture of claim 1, wherein the device is integrated with a wall of the item of furniture, in a bore thereof.

15. An item of furniture having a device for opening and damping a closing motion of a drawer of the item of furniture of claim 1, wherein the device is integrated with a guide of the drawer, the drawer being capable of being pulled out.

* * * * *